US005740558A

United States Patent [19]

Messman

[11] Patent Number: 5,740,558

[45] Date of Patent: Apr. 21, 1998

[54] MEANS FOR ATTACHING ARTICLES TOGETHER

[76] Inventor: Robert F. Messman, 600 S. Monroe Way, Denver, Colo. 80209-3521

[21] Appl. No.: 612,488

[22] Filed: Mar. 7, 1996

[51] Int. Cl.[6] ..... A41D 27/08

[52] U.S. Cl. ..... 2/239

[58] Field of Search ..... 2/239, 60; 24/390

[56] References Cited

U.S. PATENT DOCUMENTS 2,663,877 12/1953 Bohman .
3,292,748 12/1966 Rifkin .
5,272,793 12/1993 Wilk ..... 24/390

*Primary Examiner*—C. D. Crowder
*Assistant Examiner*—Shirra L. Jenkins
*Attorney, Agent, or Firm*—Ramon L. Pizarro; Edwin H. Crabtree

[57] ABSTRACT

A device for attaching flexible articles, such as clothing items having an edge. The device includes a flexible strip which includes an end with a sewable edge, and a second end having a fastening device. The device may be sown to an edge of the flexible article, such as a pair of socks, allowing the user to temporarily join a pair of socks, for example, by taking at least two of the flexible strips and stitching the sewable edge of each flexible strip to an edge of each of the socks of a pair of socks. This allows the fastening of the second end of one flexible strip to the second end of the other flexible strip, so that the clothing items may be secured together when they are not being worn.

17 Claims, 2 Drawing Sheets

MEANS FOR ATTACHING ARTICLES TOGETHER

BACKGROUND OF THE INVENTION (a) Field of the invention

This invention generally relates to field of devices for securing apparel articles together, and more particularly, but not by way of limitation, to a device for fastening socks and the like together.

(b) Discussion of the Prior Art

The need to devise a system or apparatus for joining pairs of articles of clothing together, and particularly pairs of hosiery, has long been recognized. The need to keep socks together when not in use has been identified as a very good solution to the problems associated with allowing socks to separate during laundering. Socks are separated or lost during laundering, and the task of matching socks after laundering can be very time consuming and even very difficult for individuals who are color blind, or entirely blind.

Attempts to solve these problems include various types of clips, pins, and other mechanical fasteners and devices that hold socks together during the laundering process. It has been recognized in most approaches at keeping the socks together that it is preferable to provide a mechanism or system that can be employed immediately after the socks have been removed by the wearer. This approach does not give the socks the opportunity to become separated and lost. However, the need to ensure that the user can attach the socks together immediately after using the socks requires that the sock fastening device be integral with or permanently attached to the sock.

Attempts at solving the problems associated with providing a system that becomes permanently attached to the sock include U.S. Pat. No. 5,357,660 to Smith, which teaches the use of an apparatus that includes non-sewn clamping devices to provide marking indicia that can be used while pairing the socks. While the Smith device solves the problems encountered by color blind individuals, the device has the disadvantage of requiring the user to pair the socks after laundering. Thus with the Smith device socks may still wonder away form one another and become lost. Moreover, the rigidity of the Smith device can introduce stress concentrations to the side of the garment. These stress concentrations can accelerate the wear and tear on the article. Yet another disadvantage to the Smith device is that it may be easily felt by the wearer, and thus cause discomfort to sensitive wearers. Still another disadvantage of this device, as well as other plastic devices, is that they may come loose from the sock and create a choking hazard for children.

U.S. Pat. No. 5,038,413 to Ursino teaches the use of snap type fasteners with decorative covers that conceal the fasteners while the socks are being worn. This invention, however, suffers from limitations associated with the use of rigid or resilient means for fastening the socks together. The most significant problems being that the devices can be uncomfortable to the wearer, and that the significant difference in stiffness between the fabric and the fastening means can result in tearing of the sock's fabric around the fasteners. Also, the fastening means are attached through the body of the sock, allowing tension loads to be introduced on to the fastening means. The presence of tension loads is undesirable because these loads are precisely the kinds of loads which are needed to separate the fastening means. Also, the fact that this device includes removeable covers can be especially dangerous to children who may pull the covers off, and then choke while trying to swallow the covers.

U.S. Pat. No. 4,682,389 to Cailender is yet another device made from a resilient or substantially rigid material and which attaches to the body of the sock. The Cailender device obviates the problem of separation of the socks by the tension loads transmitted by the body of the sock to the attachment means. The device solves this problem by incorporating a biased tongue and slot type of attachment means which can resist loads in a direction that is normal to the surface of the sock. However, the attachment of the device to the body of the sock has the disadvantage of introducing stresses to the sides of the sock, thus accelerating the wear and tear on the sock's fabric. Moreover the rigid, resilient material from which the device is made can be uncomfortable to the wearer and even cause the socks to slip down. The hazards associated with the possibility of choking children who swallow this device is yet another disadvantage.

In yet another example, U.S. Pat. No. 4,414,716 to Stastney teaches the use of a garment clasping device that includes a pair of flat resilient H-shaped members that may be sewn on to the body of a sock through openings on the resilient H-shaped members. Because the Stastney device includes a resilient body, it produces stress concentrations on the sock, which in turn cause rapid deterioration of the sock's fabric. Moreover, the resilient material can prove to cause discomfort to the user who may feel the presence of a resilient member attached to the socks.

Yet another attempt at solving problems associated with attaching socks and other garments together is U.S. Pat. No. 4,058,853 to Boxer et al. The Boxer patent teaches the attachment of a flexible patch containing hook and loop type material on to the body of the sock. Since the Boxer device can be made from flexible material it offers advantages in comfort to the wearer that cannot be achieved with inventions that include resilient bodies. However, the boxer device is disadvantaged in that it attaches to the sides of the sock. Attachment to the side of the sock can lead to a serious deformation of the sock during laundering. Moreover, the attachment of the device to the side of the sock allows for the introduction of significant tension loads on to the fastening means. These loads are in precisely the direction of loading that is used to disconnect the fastening means from each other.

U.S. Pat. No. 3,699,617 to Hofmeister provides yet another approach at connecting articles of clothing. The Hofmeister device uses a pair of resilient connecting members that become permanently attached to the socks. Each member includes fasteners for attachment through the socks, and connecting plugs for connecting the members to one another. This device is very helpful in ensuring that socks are not separated during laundering or handling; however, the Hofmeister device still leaves many needs unanswered. For example, the Hofmeister device relies on stud fasteners for attachment to the socks. This method of attachment is effective, but it is prone to causing tearing of the sock due to the fact that fasteners in effect concentrate the load being transferred from one sock to the other. Moreover, the use of resilient components and fasteners on the body of the sock can be uncomfortable for the wearer.

In yet another approach at providing means for preventing the separation of pairs of socks during laundering, U.S. Pat. No. 2,663,877 to Bohman, a fabric strip which is doubled up to provide a U-shaped reinforcement area that straddles the upper edge of the opening on a sock is used to support snap fasteners against the body of the sock. The device may also be used to hold D-rings on the sock. The Bobman device has the advantages of providing a flexible fabric device which does not cause discomfort to the wearer as do substantially rigid or protruding devices. However, the Bohman device can cause stress concentrations on the body of the sock. Stress concentrations can cause tearing of the sock at the boundary between the invention and the body of the sock. Thus, the Bohman device does not provide a solution that allows optimal distribution of stressed from one garment to the next. Therefore, the Bobman device does not fully address the need for a device that can evenly distribute the stresses associated with keeping two garments together, and thereby reduce the likelihood of deformation of the garments.

Moreover, by providing a device that is attachable through the body of the sock, the Bobman invention suffers from the disadvantage having a device that allows significant tension loading of the fastening means. In other words since the body of each of the socks will face one another, the pulling of the socks can introduce loads in a direction that is normal to the surface of the body of the socks. This kind of loading stresses fastening means, such as snap type fasteners, in a direction which is likely to cause separation of the fastening means. This kind of loading will cause separation of the socks and the loss of effectiveness of the device. Thus the Bohman device leaves unanswered needs in that it does not provide a simple sock joining device that ensures optimal loading of the fastening means used with the device.

There have been attempts at attaching ties or strings to the socks in order to allow the user to simply tie two socks together prior to laundering. This approach, however, has the serious disadvantage that the strings or ties may become hopelessly knotted together during laundering. Moreover, the length of the strings required for adequate tieing of the socks together may be so long that they would stick out from under a user's pant legs, or they would have to be tied in a bow in order to prevent the ties or strings from flailing about. Clearly, these alternatives can be undesirable to men or women who do not wish to wear bows on their socks or who do not want the sloppy appearance of dangling ties or strings.

Thus, a review of examples of the prior art reveals that there remains a need for a simple, secure device for fastening socks together. Importantly, there remains a need for a simple device for securing socks together in a manner that prevents damage to the socks during laundering. Also, there remains a need for a simple reliable device that can be used to connect pairs of articles of clothing, such as socks, without introducing tension loads to the fastening means, and thus allow enhanced performance of the fastening means.

Moreover, there remains a need for a sock pairing and retaining means that allows secure attachment of one sock to another without distorting the shape of the sock or introducing a stress concentration that promotes the destruction of the sock's fabric.

Also, there remains a need for a device that allows the pairing and connection of pairs of socks in a secure manner that also allows the user to separate the socks easily. There remains a need for sock attachment means that achieves high holding strength with few, unobtrusive materials.

SUMMARY

A system has been discovered to meet the above needs, which had been left unanswered by the known prior art. The system serves for attaching flexible clothing items together, the clothing items having an edge such as the edge found at the opening of a sock, and comprises the following elements:

(a) a flexible strip which includes a first end and a second end;

(b) the first end of the strip having a sewable edge;

(c) the second end of the strip having a fastening means.

With a device that includes the above elements, one may temporarily join a pair of socks, for example, by taking at least two of the flexible strips and stitching the sewable edge of each flexible strip to an edge of each of the socks of a pair of socks. Thus allowing the fastening of the second end of one flexible strip may be fastened to the second end of the other flexible strip, so that the clothing items may be secured together when they are not being worn.

It is preferred that the flexible strips of the system be made from a soft, sewable material such as fabric. This allows the system to be conveniently sewn to an edge of an opening on the body of a sock without introducing rigid or bulky attachment means.

It has been found that the advantages of the invention may be achieved by including a pair of fabric strips, each with a button and a button hole, or by including a pair of fabric strips, one having a button attached to an end, and the other having a button hole on an end. It has also been found that the system may also preferably include a pair of fabric strips, each with a male and a female plastic snap type fastening means on an end. Additionally, the invention may be made from a pair of fabric strips, one having a male plastic snap attached to an end, and the other having a female plastic snap on an end. It is also contemplated that the system may include a fastening means that comprises an area of hook material and an area loop material at an end, so that two strips of the device may be connected in the same manner as the button and button hole or the male and female snap type fasteners.

Thus it will be understood by scientists, engineers, and those skilled in the art that the disclosed invention provides for the sewn attachment of a flexible, preferably fabric, strip with at least one fastening means at an end. Importantly, the disclosed invention solves the problems associated with connecting mechanisms that introduce stress concentrations to the body of the sock, and, therefore, the disclosed invention does not accelerate the failure of the sock's fabric.

The invention also solves problems associated with sock connecting devices which can be felt by the wearer. The flexible material of the invention is not obtrusive or heavy, and thus the disclosed invention can be used with a pair of socks without interfering with the wearer's comfort.

Importantly, it will be readily understood that the disclosed invention solves problems associated with devices for joining socks and which are attachable through the body of the sock. The preferred embodiment of the invention includes a flexible strip with an end that is sewn to the edge of the opening of the body of the sock. Thus it will become apparent that with this flexible arrangement it is very difficult to transmit forces that are in a direction that is normal to the body of the sock. In other words, the combination of a tab-like, flexible body which includes fastening means near the free end of the tab, allows the creation of an effective lap joint between two socks. The lap joint being well recognized as a very efficient method of transferring a load between two members. Still further, the flexible strips and lap joint do not allow the introduction of significant tension loads on to the fastening means, and thus allow more effective use of the fastening means.

The above advantages can be achieved while obtaining improved results in safety, since the disclosed invention is not anticipated to cause risk choking to children.

An unforeseen result of the disclosed invention is the versatility achieved with the disclosed structure. Thus it is contemplated that due to the strength of the disclosed structure, the invention can be used for attaching heavy garments together, and even for attaching and carrying various articles on the garment.

Moreover, it will become apparent that the disclosed invention is simple, inexpensive to manufacture, and very easy to install. The ease of installation, unobtrusiveness, benign effects on the sock's fabric, and the effectiveness of the strength developed through the attached device provide highly desirable and useful results that were not achievable with the prior art.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it is understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
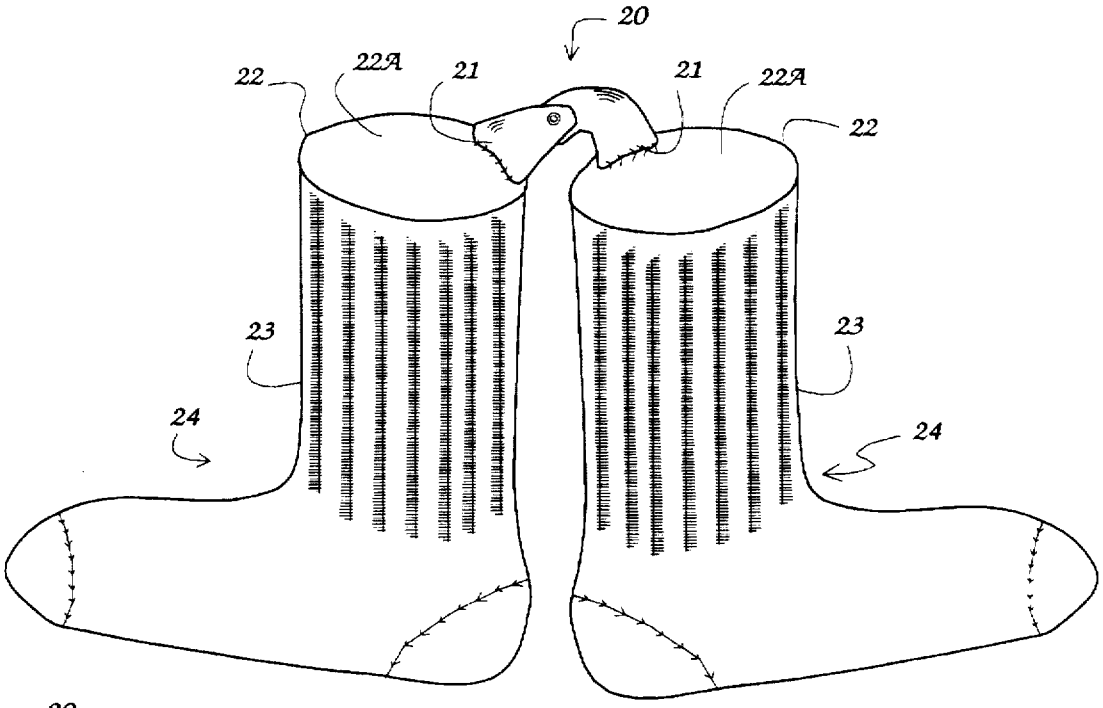
FIG. 1 illustrates an embodiment of the invention being used to keep a pair of socks together.

Turning now, to FIG. 1, which illustrates an embodiment of a system for attaching flexible clothing items together 20. As has been illustrated on FIG. 1, the system for attaching flexible clothing items together 20 is particularly well suited for connecting clothing items having an edge, such as a pair of socks, gloves or the like. In a preferred application shown on FIG. 1, the system for attaching flexible clothing items together 20 is attached by means of stitching 21 to an edge 22 found at the opening 22A of the body 23 of a sock 24 of a pair of socks.

Figure 2:
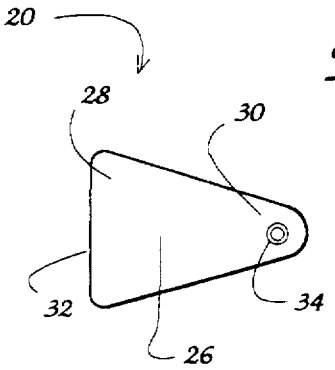
FIG. 2 is a top view of an embodiment of the invention, the embodiment including a snap type attachment means which includes both a male and female attachment means.

Referring now to FIG. 2, which illustrates a preferred embodiment of the system for attaching flexible clothing items together 20. It is shown that the system 20 includes a triangular shaped flexible strip 26, the strip having a first end 28 and a second end 30, the first end being broader than the second end and thus providing a generally triangularly shaped load path between the fastening means and the first end of the flexible strip. The first end 28 includes a sewable edge 32 which is of a sewable material that allows the flexible strip 26 to be sewn to the edge 22 on the openings 22A of the socks 24. While it is contemplated that a variety of attachment means may be used to attach the flexible strip 26 to the edge 22 of the sock 24, it is preferred that a sewable edge 32 be used instead of, for example a riveted or spot fastened attachment. However, stitching of a flexible material to the sock's fabric will result in an assembly that is made with substantially uniform materials and construction. It is also contemplated that "surge" type stitching be used to provide a strong, flexible and stretchable connection between the sewable edge 32 and the edge of the garment. Surge stitching provide continuity in similarity of materials and can even allow for butt-joint type attachment that would further enhance the unobtrusiveness of the attachment. It is advantageous to incorporate similar materials and construction in order to produce an assembly that will not be felt or noticed by a user.

As has been illustrated in FIG. 2, the second end 30 of the flexible strip 26 includes a releasable fastening means 34. The fastening means 34 may include a universal, or dual fastening system, for example a snap type fastener which includes both male and female attachment means may be used. This arrangement would allow the second end 30 of one flexible strip 26 to releasably attach to the second end 30 of another flexible strip 26, thus allowing the fabrication of a single, universal tab shaped joining device.

Figure 9:
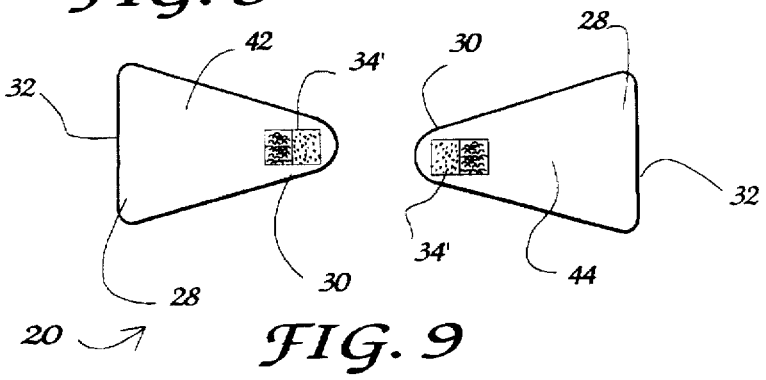
FIG. 9 is a top view of an embodiment of the invention, the embodiment including a hook and loop material as a fastening means.

It is preferred that the fastening means 34 be small plastic snap fasteners that can withstand the heat of dryers. It has been found that these small plastic snap type fasteners have the important advantages of being small, light, strong, and corrosion resistant. Also, small snap type fasteners are lees likely to snag other articles being laundered with the invention, and thus will not adversely interact with other garments during laundering. As shown on FIG. 9 an embodiment of the invention 20 includes a hook and loop material 34' as the fastening means.

Figure 4:
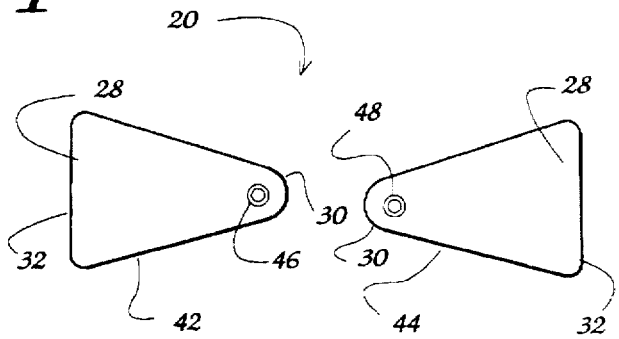
FIG. 4 is a top view of an embodiment of the invention, the embodiment including a pair of tab shaped flexible strips, one flexible strip having a male snap type fastener on one end, and the other flexible strip having a female snap type fastener on an end.
Figure 3:
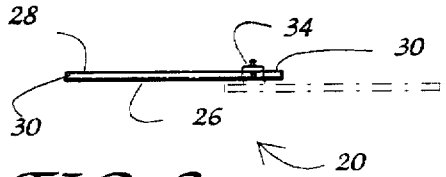
FIG. 3 is a side view of an embodiment of the device illustrated on FIG. 2, and showing a phantom outline of a mating flexible tab with a snap fastener that includes both male and female attachment means.

In the embodiment shown on FIG. 4 the system 20 includes a first flexible strip 42, which is made of fabric, and a second flexible strip 44, which is also made of fabric. Each of the strips 42 and 44 are of the same general configuration as the flexible strip 26 shown on FIG. 2. Thus, each of the embodiments shown on FIG. 4 include the first end 28 and the second end 30. Accordingly, the first end 28 also includes the sewable edge 32, and the second end 30 includes a fastening means. The first flexible strip 44 includes a first fastening means 46, which as has been illustrated may comprise a snap type fastener. Similarly, the second flexible strip 44 includes a second fastening means 48, which in a preferred embodiment includes a snap fastener that mates with the snap type fastener used on the second end 30 of the first flexible strip 42.

Figure 5:
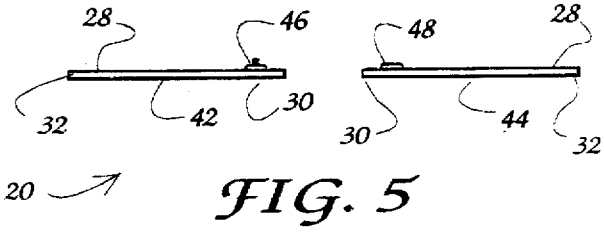
FIG. 5 is a side view of the embodiment shown on FIG. 4.

As has been illustrated in FIG. 5, the first fastening means 46 of the first flexible strip 42 is a male snap type fastener, and the second fastening means 48, found on the second flexible strip 44 is a female snap type fastener which accepts the fastening means incorporated in the first flexible strip 42 in a well known manner.

Figure 6:
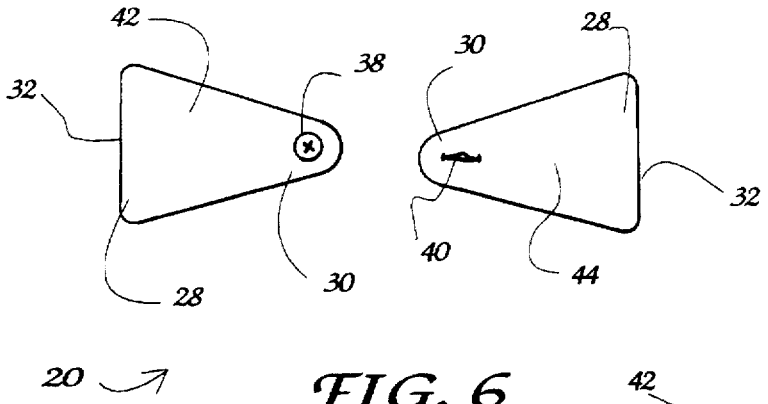
FIG. 6 is a top view of yet another embodiment of the invention, the embodiment including a pair of tab shaped flexible strips, one flexible strip having a button on one end, and the other flexible strip having a mating button hole on an end.

Turning now to FIG. 6, which illustrates yet another preferred embodiment of the invention. In this embodiment the system again includes a first flexible strip 42, which is made of fabric, and a second flexible strip 44, which is also made of fabric. Each of the strips 42 and 44 are of the same general configuration as the flexible strip 26 shown on FIGS. 2 through 5. Thus each of the embodiments shown on FIG. 6 include the first end 28 and the second end 30. Thus, the first end 28 includes the sewable edge 32, and the second end 30 includes a fastening means.

Figure 7:
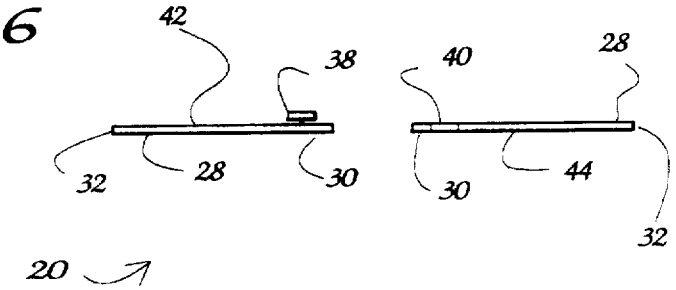
FIG. 7 is a side view of the embodiment shown on FIG. 6.

In the embodiment shown on FIGS. 6 and 7, the first flexible strip 42 includes a first fastening means, which in this embodiment is a button 38 mounted at the second end 30. Accordingly, the second end 30 of the second flexible strip 44 includes a button hole 40.

The use of buttons as the fastening means offers the important advantage of providing strong, secure, inexpensive and easy to install fastening means. Moreover, as has been illustrated in FIG. 7, the first button 38 may be installed very closely to the surface of the flexible strip 42. This offers advantages in the load carrying capabilities of the system.

Figure 8:
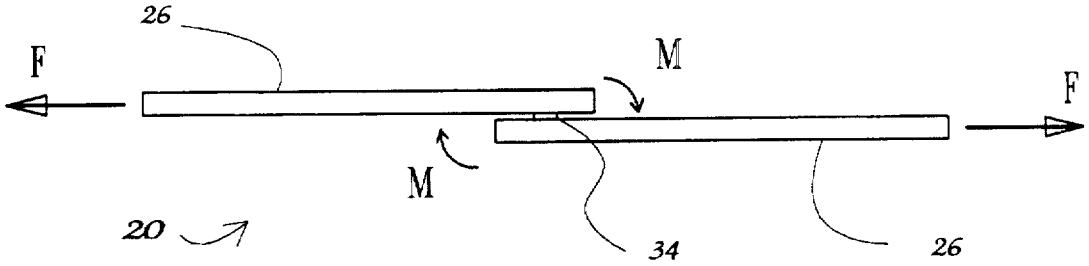
FIG. 8 is a side view illustrating the load transfer characteristics of the invention.

The importance of the use of small, low profile, fasteners can be readily understood by examining FIG. 8. The illustration in FIG. 8 is what is commonly referred to as a "free body diagram" illustrating the forces and reactions encountered by the invention when being pulled while attached to, say, a pair of socks, each sock being accelerated in a direction that is opposite to the direction of acceleration of the other sock in a washing machine, for example. The acceleration of each sock will transmit a force labeled "F" to each flexible strip 26. The forces are uniformly transmitted from the body 23 of the sock 24 by means of stitches, such as the stitching 21 shown on FIG. 1.

As has been illustrated on FIG. 8, the flexible strips 26 are connected to one another by means of the fastening means 34, creating a lap joint connection. Since the two flexible strips 26 are not on the same plane, a bending moment, labeled "M" will be created as a reaction to the force "F". The magnitude of the bending moment "M" will increase as the distance between the two flexible strips 26 increases. Thus, it is clear that by using low profile fastening means that allow the flexible strips 26 to remain close to each other one can significantly reduce the magnitude of the bending moment "M". Also, it can be appreciated from FIG. 8 the by using tab shaped, longitudinal flexible strips 26 one effectively isolates the fastening means 34 from any out of plane loads. In other words, the configuration allows flexing, which prevents the transmission of forces in a direction normal to the plane of the flexible strip, and therefore isolates forces that tend to separate the fastening means 34.

Thus it has been found that by using low profile fastening means 34, such as buttons and snap fasteners, at the second end 30 of the flexible strip 26 can provide heretofore unforeseen advantages that had not been taught or suggested by the prior art. It has been discovered that the by attaching the fastening means to an end of a flexible strip one may allow the fastening means to develop their load carrying capabilities more fully than with the prior art. When pulling a pair of socks joined by the system for attaching flexible clothing items together 20, the flexible strips 26 will bend an allow the fastening means 34 to transmit the pulling force as a shear load through the fastening means 34 and from one flexible strip to the next. In other words, the combination of flexible strips with fastening means at the ends develops an effective lap joint for transferring a shear load from one flexible strip to the next.

It is well known to scientists and engineers who design structural elements, that a lap joint, which transfers shear loads through the joint's fasteners, is preferred over other types of joints that may transfer tension loads through the fasteners. A tension load can cause separation and failure of the fastener's components; whereas a shear load stresses most fasteners through their strongest area. Many fasteners, such as snap type fasteners, or even the well known button is significantly more resistant when loaded in shear than when loaded in tension. Moreover, most snap type fasteners are designed to release in response to a tension load in a direction normal to the plane of the flexible strips of the invention 20.

Therefore, it can be appreciated that the arrangement taught in the system for attaching flexible clothing items together 20 is particularly well suited for taking advantage of the preferential loading capabilities exhibited by many small unobtrusive fasteners. For example, if one were to simply attach small snap fasteners through the sides of a sock, and then attach both socks together by means of the snap fasteners, one would likely experience separation of the socks while laundering the socks. As explained earlier, this is likely to occur due to the fact that by attaching the snap fastener through the body of the sock, one allows the sock to exert tension loads on the fastener. As has been discussed above, the existence of tension loads on the fastener are likely to cause the fastener to separate.

To attach the system to a pair of socks, for example, one would align the sewable edge 32 of the flexible strip of the system 20 with the edge 22 of the opening **22*a* on the body 23 of the sock 24. One would then stitch the sewable edge 32 to the edge 22 the sock 24. It is understood that the strength of the connection between the sewable edge 32 and the edge 22 of the opening 22A on the sock 24 depends on the kind of thread used for stitching, the number of stitches used, the type of stitch used, and the length of the edge 32 to edge 22 connection. Thus, when using the system to connect socks together, it is advantageous to adapt the length of the sewable edge 32 to allow for the amount of strength required from the sewn attachment of the first end 28 of the flexible strips to the edge 22 of the socks 24**.

It should be noted here that it is contemplated that other means could be used to attach the sewable edge 32 to the edge 22 of the opening **22*a* of the sock 24**. For example, adhesive attachment may be used. However, sewn attachment has been selected as a preferred method due to the simplicity, strength, and load distribution capabilities achievable with a sewn connection.

It is important to point out that in addition to the advantages indicated above, sewn attachment has the advantage of providing a connection that remains flexible and unobtrusive. This is particularly important in the instant application because attachment means that may be rigid, such as plastic or other rigid attachment means may be annoying to the user or so heavy that they may cause the sock to slip down on the leg.

Also, larger, heavier socks may require strong attachment connection in order to provide a means for attachment that withstand the loads encountered during laundering where the socks will become soaked with water and will be submitted to repeated jerking by the washing machine. Thus, the user may use extra stitching in order to spread out the load before transmitting the load to the body of the sock. Moreover, the device may be manufactured with longer sewable edges 32 for applications where higher loads are to be encountered. This will ensure that the sock is not deformed or torn by concentrated loads. Because it has been found that stitching provides a connection that distributes the loads, is unobtrusive, unlikely to snag other items of clothing, strong, and easy to install, and thus is the best method contemplated for attaching the sewable edge 32 to the edge 22 of the opening 22A of the sock 24.

Because of the advantages of having stitching as the preferred method of attaching the flexible strips of the invention 20 to the edge 22 of opening 22A of the socks 24, it is contemplated that the flexible strip 26 or the first flexible strip 42 and second flexible strip 44 be made of fabric. Moreover it is contemplated that a strong, flexible fabric such as materials used as reinforcement tape make very good choices as the basic stock for the flexible strips.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A system for attaching a pair of separate flexible clothing items together during laundering, each of the clothing items having an edge, the system comprising:

an elongated flexible strip, the strip having a first end and a second end, the first end having a substantially straight sewable edge and the second end having a fastening means, the fastening means covering an area on said second end that is smaller that said first end, so that at least two flexible strips may be attached through the sewable edge on the first end of each flexible strip to the edge of the flexible clothing item and so that the second end of each flexible strip is adapted to extend from the edge of the flexible clothing item and may be fastened to the second end of another flexible strip in a flexible lap joint configuration, providing a generally triangularly shaped load path between the fastening means and the first end of the flexible strip and so that the clothing items may be secured together when they are being laundered.

2. The system according to claim 1 wherein the flexible strips are made of fabric.

3. The system according to claim 2 wherein the first end of the strip is adapted for sewn attachment to an edge of an opening on a sock.

4. The system according to claim 3 wherein the fastening means comprises a plastic snap type fastener.

5. The system according to claim 3 wherein the fastening means comprises a button and a button hole.

6. The system according to claim 3 wherein the fastening means comprises an area of hook material and an area loop material.

7. A device for attaching pairs of socks together, the socks having an opening having an edge, the device comprising:

a first flexible strip, the first flexible strip having a generally triangular shade having a first end and a second end, the first end being broader than the second end and having an edge and the second end having a releasable fastening means;

a second flexible strip, the second flexible strip having a generally triangular shade having a first end and a second end, the first end being broader than the second end and having an edge and the second end having a releasable fastening means;

so that the edge of the first end of the first flexible strip may be secured to an edge of one sock and allowed to extend from the edge of the sock, and so that the edge of the first end of the second flexible strip may be attached to an edge of the other sock and allowed to extend from the edge of the sock, so that fastening means on the second end of the first flexible strip may be attached to the fastening means on the second end of the second end of the second flexible strip in a flexible lap joint configuration, whereby the socks may be secured together when they are not being worn.

8. The system according to claim 7 wherein the flexible strips are made of fabric.

9. The system according to claim 8 wherein the first end of the strip is adapted for sewn attachment to an edge of an opening on a sock.

10. The system according to claim 9 wherein the fastening means comprises a plastic snap type fastener.

11. The system according to claim 9 wherein the fastening means comprises a button and a button hole.

12. The system according to claim 9 wherein the fastening means comprises an area of hook material and an area loop material.

13. A device for attaching pairs of socks together, the socks having an opening having an edge, the device comprising:

a first fabric strip, the first fabric strip having a generally triangular shade having a first end and a second end, the first end being broader than the second end and having an edge adapted for sewn attachment the first end of the first fabric strip to the edge of the sock, and the second end having a fastening means;

a second fabric strip, the second fabric strip having a generally triangular shape having a first end and a second end, the first end being broader than the second end and having an edge adapted for sewn attachment of the first end of the second fabric strip to the edge of the sock, and the second end having releasable fastening means;

so that when the edge of the first end of the first fabric strip is be sewn to an edge of one sock and allowed to extend from the edge of the sock, and the edge of the first end of the second fabric strip sewn to an edge of the other sock and allowed to extend from the edge of the sock, the fastening means on the second end of the first fabric strip may be attached to the fastening means on the second end of the second end of the second fabric strip in a flexible lap joint configuration, whereby the socks may be secured together when they are not being worn.

14. The system according to claim 13 wherein the first end of the strip is adapted for sewn attachment to an edge of an opening on a sock.

15. The system according to claim 14 wherein the fastening means comprises a plastic snap type fastener.

16. The system according to claim 14 wherein the fastening means comprises a button and a button hole.

17. The system according to claim 14 wherein the fastening means comprises an area of hook material and an area loop material.

* * * * *